US005551981A

United States Patent [19]

Sellitto

[11] Patent Number: 5,551,981

[45] Date of Patent: Sep. 3, 1996

[54] APPARATUS TO GALVANIZE A FERROUS SUBSTRATE

[75] Inventor: Thomas A. Sellitto, Madison, Ohio

[73] Assignee: SMS Engineering, Inc., Pittsburgh, Pa.

[21] Appl. No.: 311,916

[22] Filed: Sep. 26, 1994

Related U.S. Application Data

[62] Division of Ser. No. 75,327, Jun. 11, 1993, Pat. No. 5,384, 165.

[51] Int. Cl.[6] ..... B05C 3/132

[52] U.S. Cl. ..... 118/621; 266/104; 266/110; 266/129; 118/58; 118/68; 118/69; 118/641

[58] Field of Search ..... 118/621, 641, 118/58, 68, 69, DIG. 5; 427/461, 377, 379, 185, 192, 376.5, 376.8, 398.4; 266/102, 104, 107, 109, 110, 111, 112, 114, 120, 128, 129, 133

[56] References Cited

U.S. PATENT DOCUMENTS

| | | | |
|---|---|---|---|
| 3,144,364 | 11/1960 | Robinson et al. | 148/113 |
| 3,868,925 | 3/1975 | Smith et al. | 118/621 |
| 4,037,074 | 7/1977 | Montbrun et al. | 219/121 |
| 4,088,093 | 5/1978 | Pan | 118/630 |
| 4,100,883 | 7/1978 | Lupinski et al. | 427/30 |
| 4,370,357 | 1/1983 | Swartz | 118/620 |
| 4,505,946 | 3/1985 | Susuki et al. | 427/190 |

*Primary Examiner*—Brenda A. Lamb
*Attorney, Agent, or Firm*—Clifford A. Poff

[57] ABSTRACT

A ferrous strip is galvanized by establishing an electrostatic potential on the strip which is then submerged on a fluidized bed of powdered galvanizing material and then allowing the adhered galvanized powder to be carried by the strip to a reflow station. The reflow station heats the strip and galvanizing material to liquidity the galvanizing material and establish the necessary alloy interface on the ferrous strip. Thereafter, the strip passes to a cooling zone wherein the reflowed galvanizing material is solidified before contacting a roller to use to direct the strip to the exit of the galvanizing apparatus. The atmosphere within the galvanizing apparatus is remained inert through the use of nitrogen which is also used as the fluid medium for the suspension of the galvanizing powder in the fluidized bed.

11 Claims, 1 Drawing Sheet

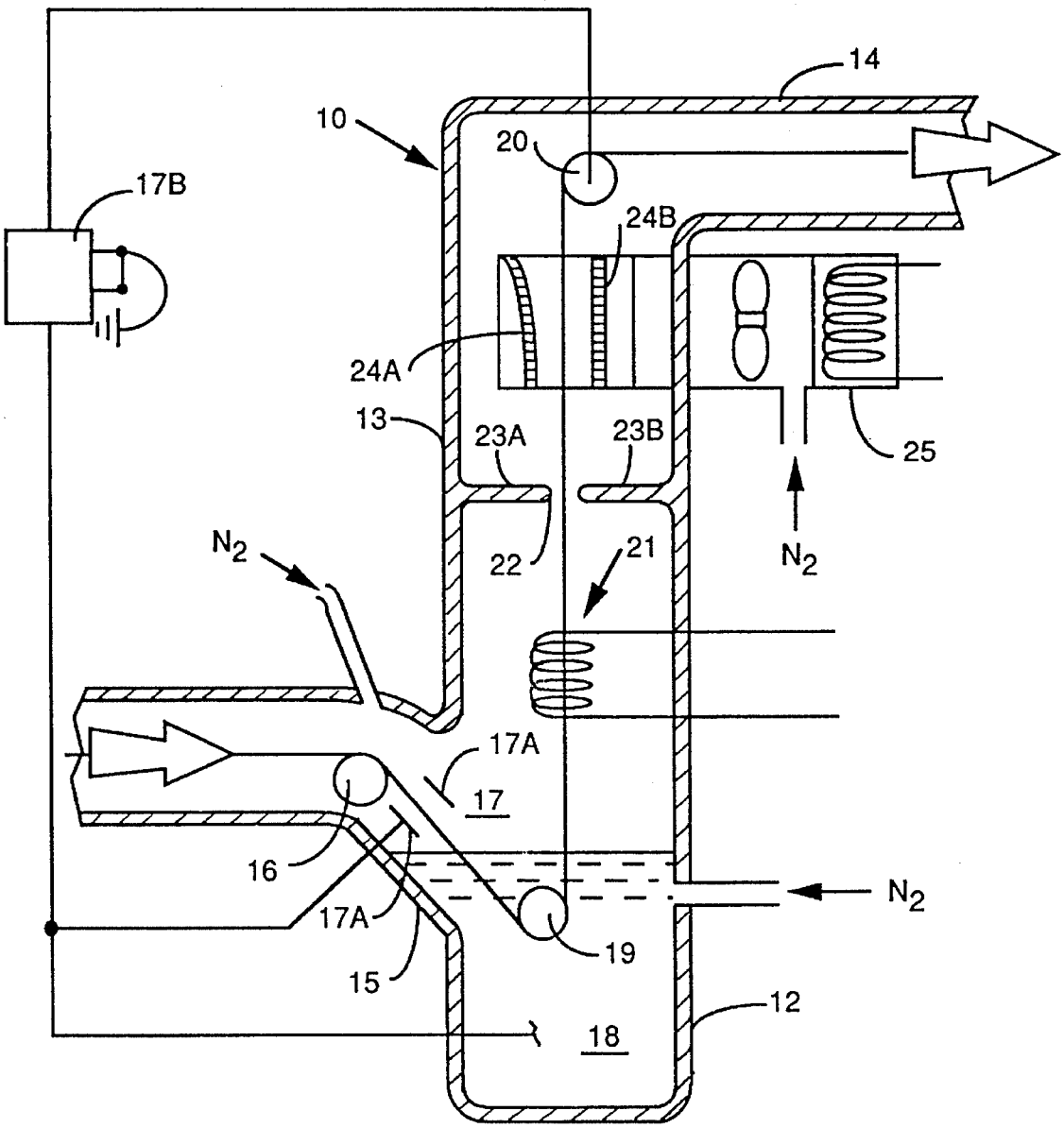
14
10
20
17B
24B
24A
13
23A
23B
25
N2
22
21
N2
17A
17
16
N2
17A
19
15
12
18

APPARATUS TO GALVANIZE A FERROUS SUBSTRATE

This application is a division of application Ser. No. 08/075,327, filed Jun. 11, 1993, now U.S. Pat. No. 5,384, 165.

BACKGROUND OF THE INVENTION

1. Field of the Invention

The present invention relates to an improved galvanizing method and apparatus incorporating the use of a fluidized bed of zinc powder for galvanizing of elongated metal substrates. More particularly, such metal substrates are galvanized by first electro-statically depositing zinc powder on the metal substrate followed by liquefying, reflowing and cooling the zinc coating within an inert atmosphere to obtain a coating thickness that is uniform and selectable over a wide range.

2. Description of the Prior Art

It has been known in the metal industry to apply a zinc coating on a base steel product by immersion into a bath of molten zinc, the purpose being to increase the life of the product by covering the base material with a protected coating metal. Under present day practices, the coating of zinc by itself or in combination with another metal may be applied by either a hot dip method or by an electroplating method.

In the hot galvanizing process, the stock to be galvanized is first annealed and then cleaned in a pickling bath of hydrochloric acid. After rinsing in hot water, the stock is immediately passed through a bath of flux, such as zinc chloride, or sal ammoniac, the purpose of which is to prevent rusting of the stock when it is dried, and to aid the reaction between zinc and iron. The stock is now ready for the application of molten zinc, or "spelter," as it is called. This is contained in a spelter pan of such size as is required for the galvanizing operation undertaken. The pan is supported on a brick setting and directly fired from below. The stock is dipped in the molten zinc for sufficient time to permit the zinc to alloy with the surface of the iron so that a coating of zinc will remain on the stock when it is withdrawn from the spelter pan. The excess zinc is allowed to drip from the galvanized stock, or is mechanically wiped from it. Air knives may be used to control the thickness of zinc before solidifying it. The galvanizing operation is now complete except for cooling the stock and cutting it into sheets, wrapping it on reels, or otherwise preparing it for commerce.

Electro-galvanizing is carried out in a plating vat, usually made of wood. In one portion of this vat are bus wires, to which the positive of the plating circuit is connected. The vat is filled with an electrolyte of some zinc salt. Zinc sulfate is frequently used. The stock to be plated is suspended in the electrolyte by metallic support which are connected to the negative of the plating circuit. Current is supplied from a special plating generator, and the circuit is completed through the electrolyte, decomposing it and plating the zinc on the cathodes, which are the pieces being galvanized. Preparations prior to electro-galvanizing are similar to those in hot galvanizing.

In the hot dip galvanizing process, while less costly, a substantial lead time is necessary so as to make available the necessary tonnage of liquid zinc to form the bath in which the strip or plate is immersed. For example, it requires several hours to melt zinc bars to provide the appropriate zinc bath. The coating thickness of the zinc is not accurately controllable although the use of air knives has achieved good results with coatings thickness above G20. Air knives, however, are generally ineffective with coating thicknesses between G20 and G10 and electro-galvanizing methods are too costly.

Accordingly, it is an object of the present invention to provide a method and apparatus to galvanize a ferrous substrate using a coating material comprised of finely divided powder adhered to the substrate by an electrostatic charge before galvanizing passage to a reflow station.

It is a further object of the present invention to provide a galvanizing process and apparatus in which a potential of an electrostatic charge is selected according to a desired coating thickness determined by a thickness of adhered powder galvanizing material to a substrate.

It is yet a further object of the present invention to provide a method and apparatus for galvanizing a ferrous substrate in which the thickness of the galvanized material can be selected to provide coating thickness of between G20 and G10.

SUMMARY OF THE INVENTION

According to the present invention there is provided a method of coating a ferrous substrate with zinc or other galvanizing material by the steps of introducing the substrate to a coating chamber having an inert atmosphere therein, electrostatically depositing a layer of zinc powder on the substrate, liquefying the zinc powder on the substrate, reflowing the liquid zinc on the substrate to create a zinc iron alloy interface, and cooling the substrate and the reflowed zinc coating thereon below the liquidous temperature of the zinc in an inert atmosphere.

According to the present invention there is also provided a method of coating a ferrous substrate with zinc, the method including the steps of introducing the substrate to a coating chamber having an inert atmosphere therein, imparting a static electric charge potential between the substrate and a volume of zinc powder, statically supporting a film of powdered zinc on the substrate in the coating chamber by immersing the charged substrate in a volume of zinc powder, heating the zinc powder coating on the substrate to a liquid temperature of the zinc, allowing the liquid zinc to reflow creating a zinc iron alloy interface, and cooling the substrate with the reflowed zinc coating thereon.

The present invention also provides an apparatus for coating a ferrous Substrate with zinc, the apparatus includes a vertically extending coating chamber separated by a restricted passageway to a cooling chamber, the coating chamber includes a fluidized bed of galvanizing powder, means for maintaining an inert atmosphere in each of the coating and cooling chambers, means for directing an elongated substrate into a fluidized bed of galvanizing powder within the coating chamber, means for establishing electrostatic potential between the strip and fluidized bed sufficient to form an electrostatic deposition of galvanizing powder on the substrate, means for heating the galvanizing powder on the substrate to a temperature sufficient to liquify the zinc for a period of time to allow reflowing with an attending zinc iron alloy interface, and means for cooling the reflowed zinc coating on the strip below the liquidous temperature of zinc in the cooling chamber, and means for directing the strip from the cooling chamber.

BRIEF DESCRIPTION OF THE DRAWINGS

These features and advantages of the present invention as well as others will be more fully understood when the following description is read in light of the accompanying drawing wherein there is schematically illustrated an elevational view of a preferred embodiment of galvanizing apparatus also useful to carry out the method of galvanizing.

DETAILED DESCRIPTION OF THE PREFERRED EMBODIMENTS

As can be seen in the drawing there is illustrated a carbon steel strip which is fed to the coating apparatus 10. A continuous supply of strip is derived by coil entry handling equipment wherein coils of strip are unwound by two or more payoff reels. When the trailing end of one coil passes from the reel it is joined with the leading end of another strip from a different one of the payoff reels to form the continuous supply of strip. Before galvanizing the strip, it is treated in a processing line that includes an annealing furnace to offset the affects of cold rolling from where the strip is cleaned and pickled before passing to a strip heating furnace where temperature of the strip is raised to about 700° F. while maintained in an inert atmosphere to prevent oxidation of the ferrous strip material. These strip processing operations per se well known in the art, are carried out to present the strip with a thoroughly cleaned, essentially oxide free, dry and preheated surface for the galvanized coating. The galvanizing apparatus includes a housing 12 which takes the form of a vertically extending mid-portion 13 having at its upper end a horizontal strip discharging upper portion 14 and, at its lower end an incline strip entry portion 15. A strip bending roller 16 traverses the entrance for the strip at the entry portion 15. The roller 16 directs the strip in a downward angular direction through a fall space 17 wherein there is located spaced apart plates 17A at opposite sides of the strip. The plates are part of a static electric charge circuit that includes a controller 17B to impart an adjustable preselected static electric charge of the order of 15,000 to 25,000 volts to the surface of the strip immediately before submersion in a bed 18 of fluidized zinc powder. The fluid medium for the fluidized bed is an inert gas, preferably nitrogen, to not only maintain a non-oxidizing atmosphere for the heated strip entering the fluidized bed but also suppress combustion in the housing 10. The strip is deflected by roller 19 in the bed of fluidized material and directed upwardly above the bed to insure the surface of the strip intimately contacts the zinc powder of the fluidized bed, such contact is essential to the retention of zinc powder on the surface of the strip in the presence of a support force due to the electrostatic charge imparted thereto on the strip. The bed of zinc material is maintained at the same positive electro-static potential as the spaced apart charging plates 17A. The zinc powder has a melting point of about 785° F. The zinc has at least about 99% purity with unavoidable impurities obtained typically by conventional powder metallurgical processes using a zinc slab as a starting material. The grain size of the powder is preferably between 5 to 15 microns. It is within the scope of the present invention to utilize other powdered galvanizing materials for example, zinc aluminum alloy, according to compositions known in the art to carryout Galfan Galvanizing.

As the strip with the coating of powder galvanizing material adhered hereto by static electric charge emerges from the fluidized bed, the strip is directed in a vertical path by a bottom deflecting roller 19 maintained at ground electrical potential. Spaced above the bath of powdered zinc there is located an induction coil that is powered by electrical current to inductively heat the strip to a temperature above the melting temperature of the galvanizing material which when pure zinc is used, the melting temperature is at least 785° F. Because the strip is preheated before entering the galvanizing apparatus, the heating requirements for reflow is reduced but nonetheless necessary so that the zinc powder liquifies and creates the necessary zinc-iron alloy interface. The reflow process is carried out in the inert atmosphere maintained in the galvanizing apparatus to avoid contamination through possible oxidation in the metal strip. The reflow process may be carried out using other forms of heat sources such a radiant heating tubes. As the strip emerges from the reflow section formed by the induction heater 21, the strip passes through a constriction 22 formed by confronting protruding walls 23A and 23B that serve to isolate the galvanizing chamber which is below these walls from a cooling chamber above the walls, all of which are located within housing 10.

In the cooling chamber, there is located a cooling unit formed by a perforated walls of headers 24A and 24B at opposite sides of the strip and supplied with cooled inert gas, such as nitrogen, from a heat exchanger 25. The strip cooler functions to essentially reduce the temperature of the galvanized strip below at 700° F. before the strip is brought into contact with roller 20. In this way, the zinc coating is completely solidified to avoid degradation to the appearance of the galvanized strip. The roller 20 directs the strip horizontally from the housing 10 into the open atmosphere.

An important feature in the present invention resides in the fact that the coating thicknesses can be effectively applied at G10 to G60 thicknesses, i.e., 0.1 ounce per foot squared to 0.6 ounce per foot squared. Heretofore, it was impossible to obtain a galvanizing strip with a coating thickness less than G20 through the use of conventional air knives to control the coating thickness. While the present invention enables thin coatings to be successfully applied, it also enables accurate control to the uniformity of the coating thickness along the length and width of the strip. By controlling the magnitude of electro-static charge on the strip the quantity of powdered galvanizing material comprising the coating thickness is controlled. The relationship is that of the greater the electrostatic potential the greater the coating thickness. This offers the distinct advantage to allow a convenient and simple control for the coating thickness. The invention also offers a significant advancement over the conventional use of liquid zinc in galvanizing pots by the elimination of many hours of lead time necessary to obtain several tons of liquid zinc. In the present invention, strip processing speeds can be greatly increased giving greater economy to the capital outlay.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An apparatus for coating a ferrous substrate with zinc, said apparatus including:

a vertically extending coating chamber separated by a restricted passageway to a cooling chamber, said coating chamber includes a fluidized bed of zinc containing galvanizing powder;

means for maintaining an inert atmosphere in each of said coating and cooling chambers;

means for directing an elongated substrate into said fluidized bed of zinc containing galvanizing powder within said coating chamber;

means for establishing electrostatic potential between said substrate and said fluidized bed sufficient to form an electrostatic deposition of zinc containing galvanizing powder on said substrate;

means for heating said zinc containing galvanizing powder on the substrate the inert atmosphere of said coating chamber to a temperature sufficient to liquefy the zinc in said zinc containing galvanizing powder for a period of time to allow reflowing and forming a zinc iron alloy interface; and means for cooling the reflowed coating on said substrate below the liquidous temperature of the coating in the inert atmosphere of said cooling chamber.

2. The apparatus according to claim 1 further including means for directing said substrate from said cooling chamber.

3. The apparatus according to claim 1 wherein said means for establishing electrical potential is variable to select the electrical potential for obtaining a desired coating thickness.

4. The apparatus according to claim 1 wherein said fluidized bed of zinc containing galvanizing powder comprises a fluidized bed of pure zinc powder.

5. The apparatus according to claim 1 wherein the grain size of the zinc contained in said zinc containing galvanizing powder is within the range of 5 to 15 microns.

6. The apparatus according to claim 1 wherein said zinc containing galvanizing powder essentially consists of zinc and unavoidable impurities.

7. The apparatus according to claim 1 wherein said zinc containing galvanizing powder consists of zinc and aluminum.

8. The apparatus according to claim 1 wherein the zinc containing galvanizing powder of said fluidized bed is suspended in a fluid medium including nitrogen.

9. The apparatus according to claim 1 wherein said electrostatic deposition of zinc containing galvanizing powder on the substrate is controlled by said means for establishing an electrostatic potential for forming a reflowed zinc coating having a thickness between 0.1 ounce per square foot and 0.6 ounce per square foot of substrate.

10. The apparatus according to claim 1 wherein the electrostatic potential established by said means for establishing an electrostatic potential is between said substrate and said zinc containing galvanizing powder of between at least 15,000 to 25,000 volts.

11. The apparatus according to claim 1 wherein said inert atmosphere in said cooling chamber is nitrogen.

* * * * *